United States Patent [19]

Kamano et al.

[11] Patent Number: 5,042,276

[45] Date of Patent: Aug. 27, 1991

[54] FULLY AUTOMATIC WASHING MACHINE

[75] Inventors: Toshiyasu Kamano, Hitachiota; Takashi Ishino; Toshiichi Ishikawa, both of Hitachi; Tamotu Shikamori, Ibaraki; Hideaki Hiratsuka, Kitaibaraki, all of Japan

[73] Assignee: Hitachi, Ltd., Tokyo, Japan

[21] Appl. No.: 556,454

[22] Filed: Jul. 24, 1990

[30] Foreign Application Priority Data

Aug. 2, 1989 [JP] Japan ..... 1-199413

[51] Int. Cl.[5] ..... D06F 33/02

[52] U.S. Cl. ..... 68/12.04; 68/12.05; 68/12.14

[58] Field of Search ..... 68/12 R, 23.3

[56] References Cited

U.S. PATENT DOCUMENTS

| | | | |
|---|---|---|---|
| 4,553,413 | 11/1985 | Genji et al. | 68/12 R |
| 4,742,698 | 5/1988 | Torita | 68/12 R |
| 4,779,430 | 10/1988 | Thuruta et al. | 68/12 R |
| 4,843,671 | 7/1989 | Hirooka et al. | 68/12 R X |

*Primary Examiner*—Philip R. Coe

*Attorney, Agent, or Firm*—Antonelli, Terry, Stout & Kraus

[57] ABSTRACT

A fully automatic washing machine comprising a washing/dehydration basket, an agitator rotatably disposed inside the washing/dehydration basket, a motor for rotating the washing/dehydration basket or the agitator, a detector for detecting the amount of wash corresponding to the washing load, a detector for detecting the level of water in the washing/dehydration basket, and a control circuit for controlling operations of washing and dehydration processes. Water-reserved-starting of the dehydration process is effected in such a manner that dehydration is started while leaving a certain quantity of water in the washing/dehydration basket. The amount of cloth is detected by the cloth amount detector before the start of the washing process or at an initial stage of the same, and a value thus detected is stored in the control circuit. Washing water is discharged while reading a signal from the water level detector before the start of the dehydration process, thereby leaving a certain quantity of water corresponding to the cloth amount value previously stored.

11 Claims, 4 Drawing Sheets

FULLY AUTOMATIC WASHING MACHINE

BACKGROUND OF THE INVENTION

This invention relates to a fully automatic washing machine of a water-reserved-starting dehydration type which rotates a washing/dehydration basket for dehydration with a small quantity of water left in the washing/dehydration basket.

Water-reserved-starting dehydration is well known and widely used as technique effective in suppressing first order resonance which occurs at an initial stage of a dehydration process.

However, water-reserved-starting entails a drawback in that washing water is bubbled between the outer surface of the washing/dehydration basket and an outer basket for receiving water, and the bubbles act to suppress the rotation of the washing/dehydration basket, resulting in failure to suitably dehydrate the wash.

SUMMARY OF THE INVENTION

In view of this problem it is an object of the present invention to provide a fully automatic washing machine in which whirling of the outer basket at the time of dehydration staring is small and in which the possibility of dehydration failure owing to bubbling is reduced. Another object of the present invention is to reduce whirling of the outer basket at the time of dehydration staring to enable the basket to be increased in diameter with respect to a fixed outer frame size and, hence, to increase the washing capacity.

In accordance with the present invention, water-reserved-starting dehydration is effected in which dehydration is started while leaving a certain quantity of water in the washing/dehydration basket. The quantity of remaining water is set according to the amount of wash, i.e., the washing load.

By the effect of the remaining water, the degree of non-uniformity of the wash distributed in the washing-/dehydration basket is reduced. Bubbling during dehydration can be suppressed by setting the quantity of remaining water according to the amount of load wash. It is thereby possible to suppress vibrations and bubbling during dehydration.

BRIEF DESCRIPTION OF THE DRAWINGS

In the accompanying drawings illustrating an embodiment of the present invention.

DESCRIPTION OF THE PREFERRED EMBODIMENT

An embodiment of the present invention will be described below with reference to the accompanying drawings.

Figure 1:
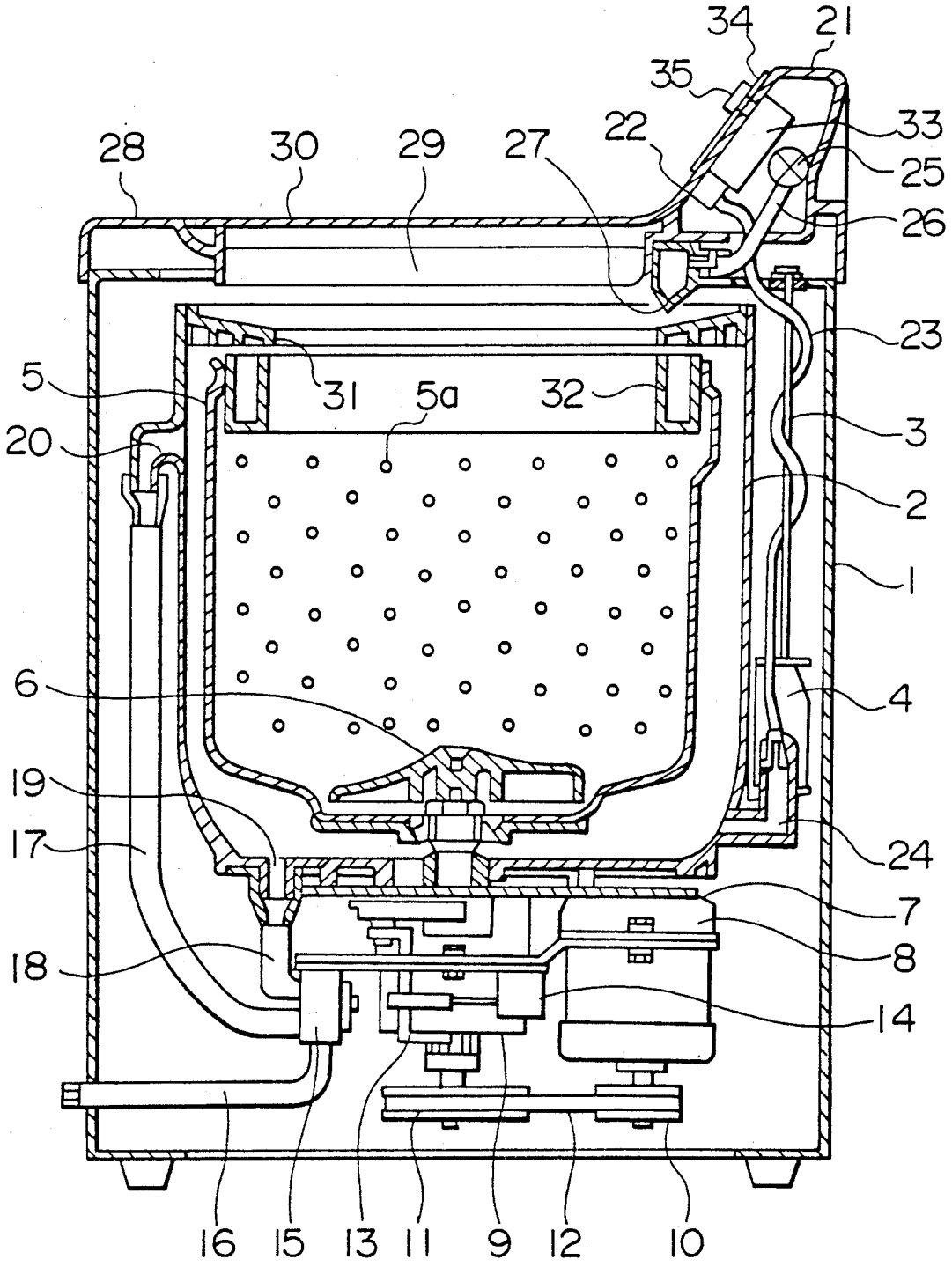
FIG. 1 is a longitudinal sectional view of a fully automatic washing machine.

First, the overall construction of a fully automatic washing machine in accordance with the present invention will be described with reference to FIG. 1. The washing machine has an outer frame 1 formed of a vibration absorbing steel plate. An outer basket 2 disposed in the outer frame 1 is suspended with suspension rods 3. The outer basket 2 is supported through vibration prevention devices 4 to absorb vibrations.

A washing/dehydration basket 5 is rotatably disposed inside the outer basket 2. The washing/ dehydration basket 5 is formed of a synthetic resin or stainless steel and has a plurality of dehydration holes 5*a*.

An agitator 6 is rotatably disposed on a central inner bottom portion of the washing/dehydration basket 5. The agitator 6 is rotated in a washing process and in a cleansing process while alternately reversing the direction of rotation with short cycles. In a dehydration process, the agitator 6 is rotated at a high speed together with the washing/dehydration basket 5 in one direction.

A support base plate 7 is attached to a bottom surface of the outer basket 2 with screws or the like. A motor 8 and a speed reduction unit 9 are supported on the support base plate 7.

The motor 8 and the speed reduction unit 9 are connected so that a torque can be transmitted by means of pulleys 10 and 11 and a belt 12.

A clutch device 13 and a clutch solenoid 14 are attached to the speed reduction unit 9. When the clutch solenoid 14 is energized, the clutch device 13 operates to transmit the torque of the motor 8 to the agitator 6 and the washing/dehydration basket 5. When the clutch solenoid is not energized, the clutch device 13 operates so that the agitator 6 is rotated while the washing/dehydration basket 5 is not rotated.

A drainage device 15 has an electromagnetic shut-off valve which is energized to be opened at the time of drainage or dehydration. A drain hose 16, an overflow hose 17 and a drain intermediate hose 18 are connected to the drainage device 15. The drain hose 16 is connected to an outlet side of the drainage device 15 while one end of the drain intermediate hose 18 is connected to an inlet side of the drainage device 15. The other end of the drain intermediate hose 18 is connected to a drain hole 19 of the outer basket 2. An upper end of the overflow hose 17 is connected to an overflow hole 20 of the outer basket 2, and a lower end of the overflow hose 17 is connected to the outlet side of the drainage device 15. Overflow water can be discharged out of the washing machine through the drain hose 16 even when the valve of the drainage device 15 is closed.

An operation box 21 is provided on an upper portion of the outer frame 1. A water level sensor 22 is provided in the operation box 21. The water level sensor 22 communicates with an air trap chamber 24 of the outer basket 2 through a pressure transmitting tube 23.

A water supply valve 25 of an electromagnetic type is provided in the operation box 21. The water supply valve 25 communicates with a water supply hole 27 through a hose 26.

A top cover 28 is provided on the outer frame 1. A lid 30 for closing a throw-in opening 29 is swingably attached to the top cover 28.

A basket cover 31 is provided on the outer basket 2. A balancer 32 disposed below the basket cover 31 is attached to the upper end of the washing/dehydration basket.

A control box 33 for controlling the operation of the washing machine is provided in the operation box 21. The control box 33 has a control circuit.

An operation panel 34 is provided on a front surface of the operation box 21. Switches for various operations including a power switch 35 and a display are disposed on the operation panel 34.

Figure 2:
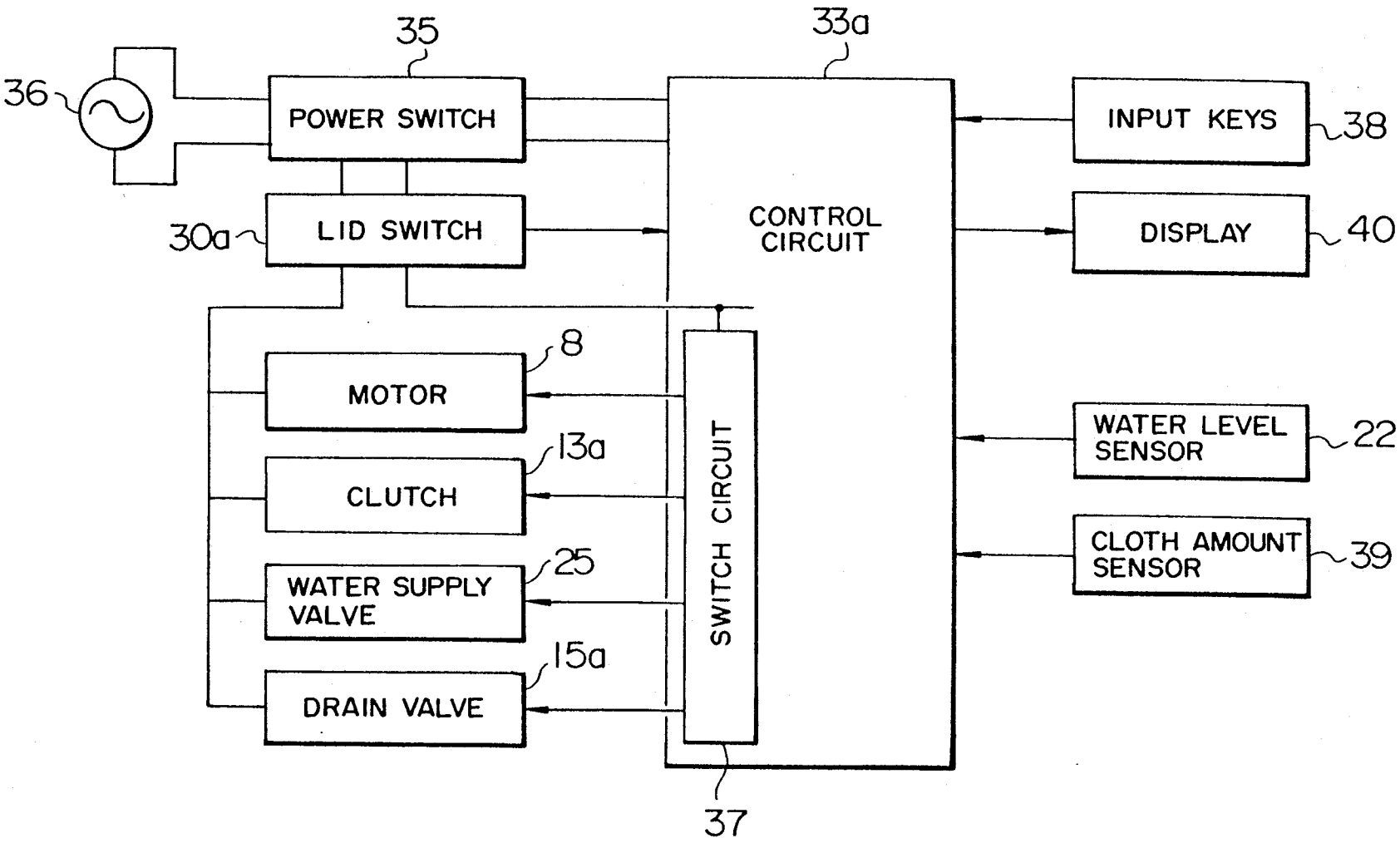
FIG. 2 is a circuit diagram including control circuit.

A circuit shown in FIG. 2 will be described below. Components corresponding to those shown in FIG. 1 are indicated by the same reference symbols.

A control circuit 33*a* is provided inside the control box 33. The control circuit 33*a* is constituted by various electronic circuitries including a microcomputer.

A power source 36 is connected to the control circuit 33*a* via the power switch 35. A lid switch 30*a* operated with the opening/closing operation of the lid 30 is connected to the power switch 35. A signal generated in response to the operation of the lid switch 30*a* is supplied to the control circuit 33*a*. Loads including the motor 8, a clutch 13*a*, a water supply valve 25 and a drain valve 15*a* are connected to the power source 36 via the lid switch 30*a* and the power switch 35 and are connected to a switch circuit 37 provided in the control circuit 33*a* and serving to drive the loads. The switch circuit 37 is connected to the power source 36 via the lid switch 30*a* and the power switch 35.

Various input keys 38 for selecting the time for a washing operation stage, the number of cleansing operation stages, the time for a dehydration operation stage, the types of water flows, the water level, and so on are connected to the control circuit 33*a*. The water level sensor 22 and a sensor 39 for detecting the amount of cloth are connected to the control circuit 33*a*. A display 40 connected to the control circuit 33*a* serves to indicate the input state of each input key as well as the operating state.

Figure 3:
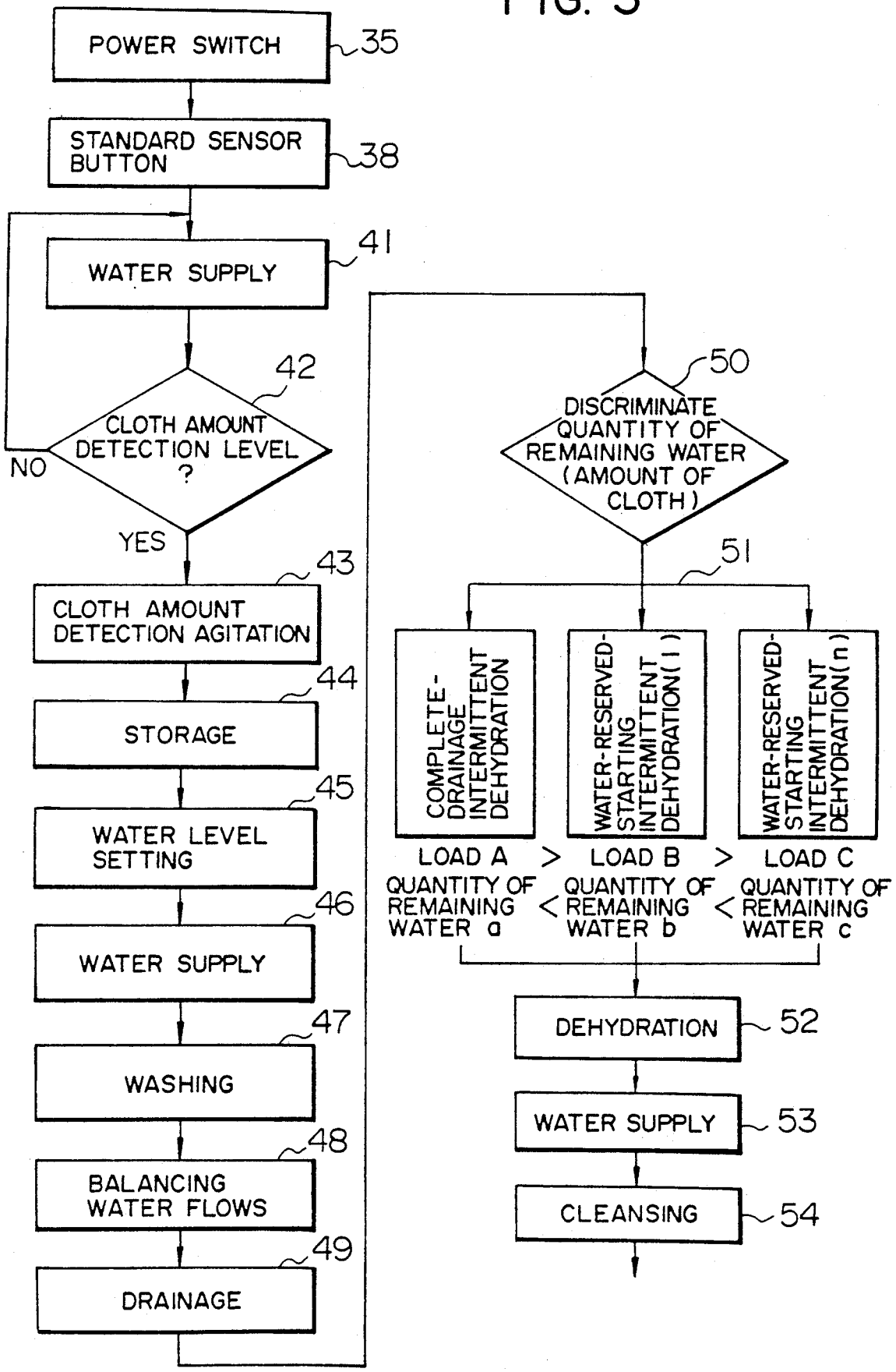
FIG. 3 is a flow chart showing the operation of the washing machine.

Next, the operation of the washing machine will be described below with specific reference to FIG. 3.

Clothes to be washed and a detergent are put into the washing/dehydration basket 5. The power switch 35 is thereafter turned on and a standard sensor button in the input keys 38 is selected. Then the switch circuit 37 is operated by an instruction from the control circuit 33*a* to open the water supply valve 25, thereby supplying water to the washing/dehydration basket 5. When the supply of water is started, the switch circuit 37 is also operated by other instructions from the control circuit 33*a* to actuate the motor 8 and the clutch 13*a*, thereby rotating the washing/dehydration basket 5 and the agitator 6 together in one direction. The motor 8 is intermittently energized; it is on for 0.5 sec and is off for 4 sec, thereby being rotated slowly at 20 to 30 rpm. Water is sprinkled uniformly on the wash to reduce the volume of the same.

During water supply step 41 in which water is supplied to the washing/dehydration basket 5, the water level in the washing/dehydration basket 5 is successively detected by the water level sensor 22 and the control circuit 33*a* (in step 42). If it is detected in step 42 that a cloth amount detection water level is reached, the switch circuit 37 is operated by an instruction from the control circuit 33*a* to close the water supply valve 25. The amount of cloth is thereafter detected.

The detection of the amount of cloth will be described below. The amount of cloth corresponds to the washing load.

When the water level in the washing/dehydration basket 5 reaches the cloth amount detection level, the water supply valve 25 is closed to stop supplying water. Simultaneously, the clutch 13*a* is operated to rotate the agitator 6 alone. That is, during the water supply, the clutch 13*a* is in the same position as the dehydration operation stage. The clutch 13*a* is therefore operated to be set in the same position as the washing operation stage.

Before the amount of cloth is detected, an operation cycle in which the agitator 6 rotates in the normal direction for 0.5 sec (ON), pauses for 0.5 sec (OFF) and rotates in the reverse direction for 0.5 sec (ON) is repeated for 8 sec. This agitation is weak in comparison with the ordinary washing operation stage but is effective in making the washing water permeate the wash.

Thereafter, an operation of detecting the amount of cloth in step 43 is started. The rotation of the agitator 6 is repeatedly reversed in order of normal rotation for 0.4 sec (ON), a pause for 1 sec (OFF) and reverse rotation for 0.4 sec (ON). The speed of inertial rotation of the agitator 6 during the OFF period is measured to detect the amount of cloth. The measurement of this rotational speed will be described below more concretely.

During the inertial rotation, a back electromotive force is caused across a phase advancing capacitor of the motor 8. This back electromotive force is converted into pulses of direct current rectangular waves, and a time $t_1$ between the pulses is measured to determine the amount of cloth.

The time $t_1$ is long when the amount of wash is large, or is short when the amount of wash is small, since the speed of the inertial rotation is low when the amount of wash is large, or is high when the amount of wash is small. It is thus possible to measure the amount of cloth by measuring the time $t_1$ between the pulses.

The measured time $t_1$ which is the data on the amount of cloth is stored in step 44. The data is stored in a cloth amount memory of the microcomputer in the control circuit 33*a*.

The level of washing water, the washing time necessary for the washing operation stage, the time for dehydration operation stage and so on are determined on the basis of the measured amount of cloth.

The level of washing water necessary for the washing operation stage is set in step 45. Additional water supply is effected in step 46 until the set water level is reached. Thereafter, an operation of the washing operation stage is started in washing step 47. The water level is checked one minute after the time when agitation washing based on normal/reverse rotation of the agitator 6 is started. If the water level is lower than the level set in step 45, water is resupplied. Water resupply is necessary because the water is absorbed in the wash after washing has been started.

After water has been resupplied to the suitable level, agitation washing is effected again. A balancing water flow operation in step 48 is started a short time before the end of the washing operation stage. This operation is effected to reduce an unbalance of the wash caused in the preceding washing operation. The balancing water flow operation is based on repeating a cycle in which the agitator 6 rotates in the normal direction for 0.3 sec (ON), pauses for 0.2 sec (OFF) and rotates in the reverse direction for 0.3 sec (ON).

After the washing operation stage has ended, the process proceeds to step 49 of the dehydration stage. In the dehydration stage, the washing water is discharged according to the amount of wash. If the amount of wash is equal to a rated amount (a maximum amount of cloth which can be sufficiently washed), the quantity of drainage is determined so that the quantity of water left in the washing/dehydration basket 5 is substantially zero or small. If the amount of wash is smaller than the rated amount, the quantity of remaining water is increased. That is, the drainage in step 49 is effected while measuring the quantity of remaining water in step 50. In step 50, the quantity of remaining water is determined according to the amount of cloth measured before the washing operation stage. The drainage is effected while the water level sensor 22 and the control circuit 33*a* are checking whether or not the quantity of remaining water in accordance with the amount of cloth is reached.

The quantity of remaining water is changed according to the amount of cloth in this way in order to reduce the amount of unbalance caused in the dehydration operation stage.

A dehydration operation which is first performed after the drainage is an intermittent dehydration in step 51. For this intermittent dehydration, one of a plurality of types of dehydration, i.e., complete-drainage intermittent dehydration, water-reserved-starting intermittent dehydration (1), ... water-reserved-starting intermittent dehydration (n) is selected.

After the intermittent dehydration, a dehydration operation in step 52 (continuous dehydration) is performed.

For dehydration, the clutch 13*a* operates so that the torque of the motor 8 is transmitted to both the washing/dehydration basket 5 and the agitator 6. The motor 8 rotates continuously in one direction, and the washing/dehydration basket 5 rotates at 900 rpm at the maximum. For intermittent dehydration, the power supply to the motor 8 is repeatedly switched on and off so that the speed of rotation of the washing/dehydration basket 5 is alternately increased and reduced but is gradually increased in a stepping manner.

The intermittent dehydration in step 51 will be described again with respect to the amount of cloth (load) and the quantity of remaining water.

Complete-drainage intermittent dehydration is selected when the amount of wash is represented by a load A corresponding to the rated (maximum) amount. At this time, a quantity of remaining water a is set which is equal or close to zero.

Water-reserved-starting intermittent dehydration (1) is selected when the amount of wash corresponds to a load B smaller than the load A. At this time, a quantity of remaining water b is set which is slightly greater than the quantity of remaining water a.

Water-reserved-starting intermittent dehydration (n) is selected when the amount of wash corresponds to a load C smaller than the load B. At this time, a quantity of remaining water c is set which is slightly greater than the quantity of remaining water b.

When the amount of wash is smaller than the load C, the quantity of remaining water is further increased.

If the quantity of remaining water is set according to the amount of wash in this way, the amount of unbalance caused during dehydration can be suppressed to a low level.

The occurrence of this unbalance will be described below more concretely with reference to FIG. 4 which shows data of occurrence of unbalance when the quantity of remaining water is zero. The ordinate represents the extent of whirling of the outer basket and the abscissa represents the capacity of wash (load). The extent of whirling of the outer basket relates to first order vibration caused during dehydration when the washing-/dehydration basket 5 rotates at 100 to 150 rpm. This vibration is magnified to appear as whirling of the outer basket.

Figure 4:
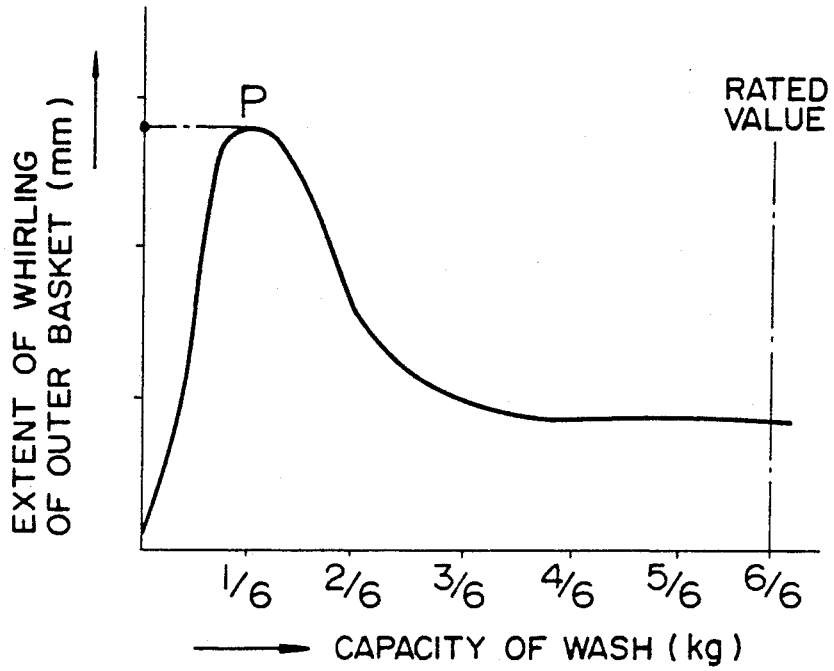
FIG. 4 is a graph showing the relationship between the capacity of wash and the extent of whirling of the outer basket.

As shown in FIG. 4, the extent of whirling is small with respect to a range of load between the rated load and 3/6 the rated load. As the load is reduced below 2/6 the rated load, the extent of whirling abruptly increases. The extent of whirling peaks as indicated at P when the load is 1/6 the rated load. As the load is reduced below 1/6 the rated load, the extent of whirling abruptly decreases.

The following is a possible explanation of the reason for such changes in the extent of whirling of the outer basket with respect to the load.

When the amount of wash is within a range between the rated load and 1/2 the rated load, it occupies the whole of the bottom of the washing/ dehydration basket and the degree of non-uniformity of the load distribution is comparatively small. When the amount of wash is not larger than $\frac{1}{3}$ the rated load, it does not occupy the whole of the basket bottom and the possibility of the load being one-sidedly distributed is increased. It is considered that this load distribution non-uniformity relates to the extent of whirling of the outer basket, and that the extent of whirling of the outer basket is reduced when the load is very small because the load distribution non-uniformity is negligible in terms of the weight of the washing/dehydration basket, although the degree of non-uniformity is large.

Water-reserved-starting is effective in reducing the extent of whirling of the outer basket. It can be understood that it is preferable to effect water-reserved-starting when the amount of wash is $\frac{1}{2}$ the rated load or less.

The operation of the present invention including water-reserved-starting will be described below with reference to FIG. 5 with respect to the effect of reducing the extent of whirling of the outer basket.

Figure 5:
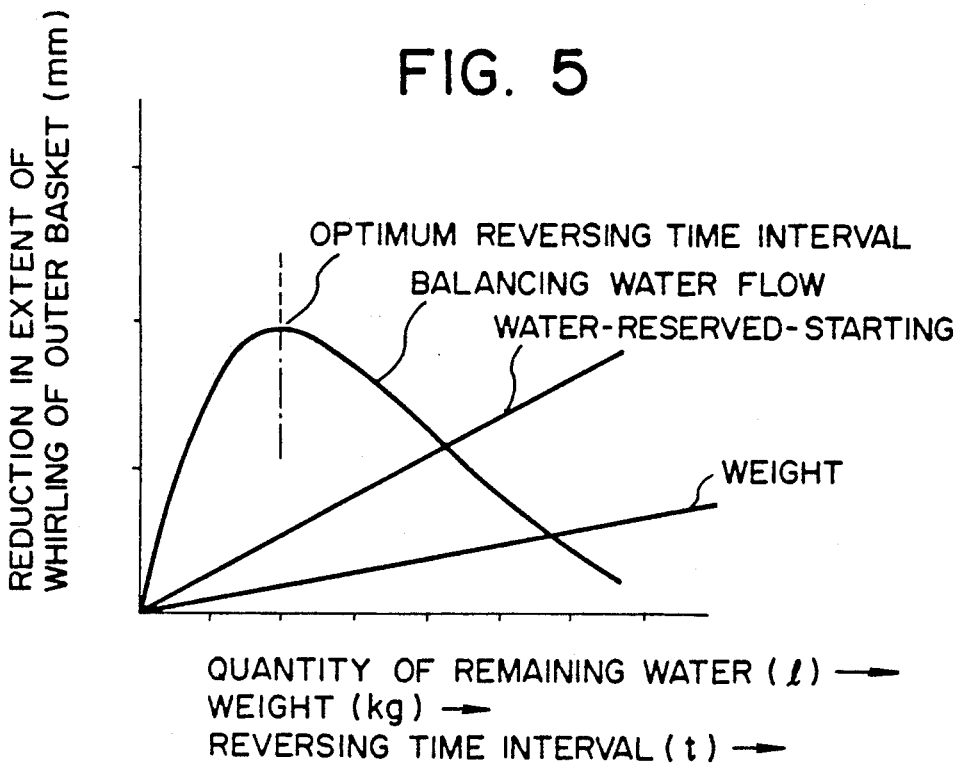
FIG. 5 is a graph showing the reduction in the extent of whirling of the outer basket.

In FIG. 5, the ordinate represents the reduction in the extent of whirling of the outer basket and the abscissa represents the quantity of remaining water, the weight (of a vibration limiting weight member attached to the outer basket or the washing/ dehydration basket) and the reversing time intervals of the agitator. In this case, the reduction in the extent of whirling is based on the reduction in first order vibration.

First, flows of balancing water will be described below. The step of forming flows of balancing water is effected before the dehydration operation stage in order to reduce the non-uniformity of the distribution of wash on the inner bottom of the washing/dehydration basket. Flows of balancing water are formed by selecting the time intervals at which the rotation of the agitator 6 is reversed. It is most preferable to set the reversing time interval of the agitator 6 to 0.3 sec (ON) for normal rotation, 0.2 sec (OFF) for pauses, and 0.3 sec (ON) for reverse rotation. If the reversing time intervals deviate from these values, the degree of non-uniformity of wash is increased, resulting in an increase in the extent of whirling of the outer basket.

If the reversing time intervals are set in this way, the agitator 6 is reversed when the angle of rotation of the agitator 6 in each direction is smaller than the angle corresponding to one revolution, and this is considered to be effective in reducing the non-uniformity of wash. It is considered that if the agitator 6 is repeatedly reversed by restricting the angles of rotation, the wash is shaken so that the non-uniformity of the wash caused during the washing operation stage is reduced.

Next, the use of a weighting method will be described below.

A weight is attached to an upper or lower portion of the outer basket 2 or the washing/dehydration basket 5. This weight serves to suppress the whirling of the outer basket 2 when the outer basket 2 whirls together with the washing/dehydration basket 5 during dehydration. As this whirling prevention weight is increased, the extent of whirling of the outer basket 2 is reduced. However, this weighting is undesirable because the total weight of the product is increased. If the weight is attached to the washing/dehydration basket 5, a problem of deficiency in the torque of the motor 8 and a problem of an increase in the size of the brake device are encountered.

Next, water-reserved-starting will be described below.

A water-reserved-starting method is based on starting the rotation of the water/dehydration basket 5 while maintaining a certain quantity of water therein. As the quantity of remaining water is increased, the reduction in the extent of whirling of the outer basket 2 becomes greater. The water-reserved-starting method is more effective than the weighting method in reducing the extent of whirling, and is more advantageous in terms of total product weight, more torque and brake performance. The water-reserved-starting method has the effect of reducing whirling of the outer basket irrespective of the wash load. However, as mentioned above, the quantity of remaining water is reduced when the load is large, and is increased when the load is small. The reason for this setting of the quantity of remaining water is as described below.

That is, bubbles are formed between the outer periphery of the washing/dehydration basket 5 and the inner surface of the outer basket 2 when the washing/ dehydration basket 5 is rotated for dehydration. The bubbles act to suppress the rotation of the washing/ dehydration basket 5. If the quantity of washing water discharged to the outer periphery of the washing/ dehydration basket 5 is large, bubbles formed at this position are increased so that the effect of suppressing the rotation of the washing/dehydration basket 5 is increased. As the load, i.e., the amount of wash is increased, the quantity of washing water discharged to the outer periphery of the washing/dehydration basket 5 is correspondingly increased. It is therefore necessary to reduce the quantity of remaining water when the load is large. Unless the quantity of remaining water is reduced, bubbles are excessively increased and the speed of rotation of the washing/dehydration basket 5 cannot be increased, resulting in failure to effect suitable centrifugal dehydration. There is also a risk of the rotational load of the motor 8 being excessively increased so that the temperature of the motor 8 becomes excessively high.

The step of intermittent dehydration before the continuous rotation dehydration in step 52 is provided in consideration of suppression of generation of bubbles.

That is, the intermittent dehydration is effected by rotating the washing/dehydration basket 5 for dehydration while switching on and off the power supply to the motor 8. When the rotational speed of the washing-/dehydration basket 5 becomes several hundred revolutions per minute, the motor 8 is switched off. When the speed of inertial rotation of the washing/ dehydration basket 5 decreases to about 200 rpm, the motor 8 is switched on. This operation is repeated to gradually dehydrate the wash. It is thereby possible to effect dehydration while suppressing generation of bubbles.

In a dehydration process based on the water-reserved-starting method, the quantity of dehydration water at an initial stage of dehydration is larger in comparison with a process of effecting dehydration after completely discharging the washing water. In the case of water-reserved-starting, it is specifically necessary to perform intermittent dehydration before the dehydration operation of continuously rotating the washing-/dehydration basket 5.

The speed of inertial rotation of the washing/ dehydration basket 5 during intermittent dehydration is set to 200 rpm or higher in order to reduce the extent of whirling of the outer basket 2. As mentioned above, the first order resonance point at which the whirling of the outer basket 2 is maximized is at 100 to 150 rpm. If intermittent dehydration is effected at a speed falling into this range, first order resonance is repeated. It is therefore necessary to set the speed of rotation for intermittent dehydration to a level higher than the range of rotational speeds at which first order vibration is caused.

As mentioned above, the quantity of remaining water is increased when the washing load, i.e., the amount of wash is large. The quantity of remaining water is, at the maximum, about 12 l (in the case of an experimental machine). (This value is dependent upon the sizes of the outer basket and the washing basket.) That is, the quantity of remaining water is set to 12 l when the load is 1/6 the rated load. This quantity of remaining water includes washing water left before the dehydration rotation between the outer basket 2 and the washing/dehydration basket 5, and therefore tends to generate bubbles at a high rate. It is therefore necessary to effect intermittent dehydration to suppress the generation of bubbles.

Next, the cleansing operation stage will be described below.

After the intermittent dehydration, the process proceeds to step 52 for the continuous-rotation dehydration operation stage to sufficiently remove washing water remaining in the wash. Thereafter, water supply operation in step 53 is performed and the process proceeds to step 54 for the cleansing operation stage.

After the cleansing operation, dehydration is effected. For this dehydration, there is no need of intermittent dehydration because the amount of remaining detergent is very small. If the amount of remaining detergent is so large that substantial bubbles are formed, it is desirable to perform intermittent dehydration.

Water-reserved-starting is effected in the same manner as the above-described dehydration. The operation of the cleansing stage may be performed two times in the same manner. In this case, it is effected in the same manner as the above-described cleansing operation.

In the above-described embodiment, intermittent dehydration is effected before the continuous-rotation dehydration in order to suppress generation of bubbles. However, continuous-rotation dehydration may be performed first without effecting any intermittent dehydration. In this case, it is preferable to use a detergent capable of suppressing generation of bubbles. Also, the rotational speed of the washing/dehydration basket 5 may be increased gradually.

In accordance with the present invention, in a fully automatic washing machine in which the water-reserved-starting dehydration is effected in such a manner that dehydration is started while leaving a certain quantity of water in the washing/dehydration basket, the water level (quantity of remaining water) at the time of starting the dehydration operation stage is set according to the amount of wash, thereby making it possible to reduce vibrations while preventing dehydration failure owing to generation of bubbles.

What is claimed is:

1. A fully automatic washing machine comprising:
a washing/dehydration basket;
an agitator rotatably disposed inside said washing-/dehydration basket;
a motor for rotating said washing/dehydration basket or said agitator;
cloth amount detection means for detecting the amount of load wash;
water level detection means for detecting the level of water in said washing/dehydration basket; and
a control circuit for controlling operations of washing and dehydration processes;
wherein water-reserved-starting of the dehydration process is effected in such a manner that dehydration is started while leaving a certain quantity of water in said washing/dehydration basket;
characterized in that there is provided with remaining water control means for controlling the quantity of remaining water at the time of starting of the dehydration process according to the amount of load wash.

2. A fully automatic washing machine according to claim 1, wherein the quantity of remaining water is increased when the amount of load wash is small.

3. A fully automatic washing machine according to claim 1, wherein when the amount of load wash is equal to a rated (maximum) value, the quantity of remaining water is zero or very small.

4. A fully automatic washing machine according to claim 1, wherein intermittent dehydration based on intermittently rotating said washing/dehydration basket is effected before dehydration based on continuously rotating said washing/dehydration basket.

5. A fully automatic washing machine comprising:
a washing/dehydration basket;
an agitator rotatably disposed inside said washing-/dehydration basket;
a motor for rotating said washing/dehydration basket or said agitator;
cloth amount detection means for detecting the amount of load wash;
water level detection means for detecting the level of water in said washing/dehydration basket; and
a control circuit for controlling operations of washing and dehydration processes;
wherein water-reserved-starting of the dehydration process is effected in such a manner that dehydration is started while leaving a certain quantity of water in said washing/dehydration basket;
characterized in that there is provided with remaining water control means for detecting, with said cloth amount detection means, the amount of cloth before the start of the washing process or at an initial stage of the washing process, for storing a value thus detected, and for controlling the quantity of remaining water to be left before the start of the dehydration process according to said detected and stored value.

6. A fully automatic washing machine according to any one of claims 1 to 5, wherein the quantity of remaining water is detected by said water level detection means.

7. A fully automatic washing machine according to any one of claims 1 to 5, wherein a plurality of dehydration holes are formed in said washing/dehydration basket, and said washing/dehydration basket is placed in an outer basket serving as a water reservoir.

8. A fully automatic washing machine comprising:
a washing/dehydration basket;
an agitator rotatably disposed inside said washing-/dehydration basket;
a motor for rotating said washing/dehydration basket or said agitator;
a cloth amount sensor for detecting the amount of load wash;
a water level sensor for detecting the level of water in said washing/dehydration basket;
a water supply valve for supplying water to said washing/dehydration basket;
a drain valve for discharging water from said washing/dehydration basket; and
a control circuit for controlling operations of washing and dehydration processes and driving of said motor, said water supply valve and said drain valve;
wherein water-reserved-starting of the dehydration process is effected in such a manner that dehydration is started while leaving a certain quantity of water in said washing/dehydration basket;
characterized in that the amount of cloth is detected by said cloth amount detection sensor before the start of the washing process or at an initial stage of the washing process; a value thus detected is stored in said control circuit; draining is effected by opening said drain valve before the dehydration process; a reduction in the water level caused by draining is detected by said water level detection sensor; and said drain valve is closed by an instruction from said control circuit when a signal representing the water level corresponding to the cloth amount value detected and stored is supplied from said water level sensor to said control circuit.

9. A fully automatic washing machine according to claim 8, wherein the detection of the amount of cloth by said cloth amount sensor is effected by alternately rotating said agitator in normal and reverse directions at short reversing time intervals and measuring the number of inertial revolutions caused by the normal and reverse rotation.

10. A fully automatic washing machine according to claim 9, wherein the detection of the amount of cloth is effected when the water level is lower than the level at which the washing process is conducted.

11. A fully automatic washing machine according to claim 8, wherein the agitation rotation of said agitator during the washing process is alternately reversed at short reversing time intervals, the wash is agitated with balancing water flows before draining at the end of the washing process, and said balancing water flows are formed at time intervals shorter than the reversing time intervals at which the rotation of said agitator is reversed in the washing process.

* * * * *